US007932793B2

(12) United States Patent
Wu et al.

(10) Patent No.: US 7,932,793 B2
(45) Date of Patent: Apr. 26, 2011

(54) COMMON MODE FILTERING METHOD AND DEVICE

(75) Inventors: Tzong-Lin Wu, Taipei (TW); Shu-Jung Wu, Taipei (TW)

(73) Assignee: National Taiwan University, Taipei (TW)

( * ) Notice: Subject to any disclaimer, the term of this patent is extended or adjusted under 35 U.S.C. 154(b) by 180 days.

(21) Appl. No.: 12/352,500

(22) Filed: Jan. 12, 2009

(65) Prior Publication Data

US 2010/0052820 A1 Mar. 4, 2010

(30) Foreign Application Priority Data

Aug. 29, 2008 (TW) ..... 97133399 A

(51) Int. Cl.
*H01P 1/203* (2006.01)

(52) U.S. Cl. ..... 333/204; 333/185

(58) Field of Classification Search ..... 333/204, 333/205, 185, 181

See application file for complete search history.

(56) References Cited

OTHER PUBLICATIONS

Liu et al., IEEE Microwave and Wireless Components Letters, "An Embedded Common-Mode Suppression Filter for GHz Differential Signals Using Periodic Defected Ground Plane", 18(4):248-250 (2008).

Wu et al., "A Novel HU-Shaped Common-Mode Filter for GHz Differential Signals", IEEE EMC Symposium (Detroit COBO Center, Room W2-65), Aug. 18, 2008.

Wu, "A Broadband Common-Mode Suppression Filter for Gbps Differential Signals Using a Novel HU-Shape Defectec Ground Structure", Industrial Technology R&D Master Program in Electrical, Communication and Electronics Engineering College of Electrical Engineering and Computer Science, National Taiwan University, Master Thesis, Jun. 2008.

*Primary Examiner* — Stephen E Jones

(74) *Attorney, Agent, or Firm* — Peter F. Corless; Steven M. Jensen; Edwards Angell Palmer & Dodge LLP

(57) ABSTRACT

Provided are common mode filtering method and device for use with a defected ground structure, the device including a substrate, coupled microstrip lines formed on the substrate and a ground plane formed underneath the substrate, the common mode filtering method being characterized by forming at least a defected ground structure on the ground plane and making dual mode signals pass through the coupled microstrip lines, thereby using the defected ground structure to suppress dual model noises within a specific frequency band and prevent signal distortion.

46 Claims, 4 Drawing Sheets

COMMON MODE FILTERING METHOD AND DEVICE

BACKGROUND OF THE INVENTION

1. Field of the Invention

The present invention relates generally to common mode filtering methods and devices, and more particularly to a method and device for use with different defected ground structures to suppress common mode noises.

2. Description of Related Art

Along with wide application of various kinds of electronic equipments, television networks, switches, mobile communication equipments and office automation equipments, electromagnetic environment of electronic systems is becoming more complicated and EMI (Electromagnetic interference) is becoming an increasingly severe problem, which adversely affects operation of the electronic systems.

Generally, differential signals are used for high-speed data transmission, such as USB 3.0 and IEEE 1394, so as to reduce noise interference. Since differential signals generate much less noise and suppress common mode noise, signal distortion can be avoided. However, coupling noise interference often leads to currents of same phase in two signals, i.e., common mode currents, which are the main source of EMI and should be considered in circuit wiring and design.

EMI is divided into radiated interference and conducted interference according to energy transmission methods. The radiated interference is preferably eliminated by shielding technique and the conducted interference is preferably eliminated and suppressed by magnetic filtering elements. An anti-EMI element can be disposed as close as possible to an interference source so as to efficiently prevent generation of radiated interference.

The most commonly used method for suppressing common mode current is to externally add a common mode choke. The common mode choke comprises two separate coils having a same number of turns and wound on a common magnet, which is equivalent in structure to a magnetic core coil. Such a filter suppresses noise through impedance and frequency characteristics of the magnetic material. The impedance of the magnetic core coil at high frequency is far greater than the impedance at low frequency, and in order to obtain a preferred interference filtering effect, the filter has a maximum impedance at the center frequency of the interference. Combination of self inductance and mutual inductance in a choke leads to a high impedance so as to eliminate common mode noise. However, frequency characteristic and parasitic effect of the ferromagnetic material prevents the common mode choke from operating at frequencies of GHz.

In addition, with the recent progress of multi-layer board fabrication process, a method of controlling the EMI radiation through PCB stack-up is proposed. Although this method has a design concept similar to the common mode choke, its fabrication process is rather complicated and costly.

Therefore, how to provide a common mode filtering method and device with simplified fabrication process, low fabrication cost and good suppression effect has become urgent.

SUMMARY OF THE INVENTION

According to the above drawbacks, the present invention provides a filtering device for use with a defected ground structure, which comprises: a substrate; coupled microstrip lines disposed on the substrate for passing through dual mode signals; and a ground plane disposed underneath the substrate and having at least one defected ground structure for suppressing common mode signals within a specific frequency band that pass through the coupled microstrip lines, wherein the defected ground structure comprises: a first rectangular region, a second rectangular region which has a same size as the first rectangular region and is parallel with the first rectangular region, and a third rectangular region with two sides thereof connecting the first and second rectangular regions respectively, the sides of the first and second rectangular regions contacting the third rectangular region having a length greater than said two sides of the third rectangular region.

According to another embodiment, the defected ground structure further comprises: a first line segment formed at one side of the first and second rectangular regions, with its projection crossing the coupled microstrip lines; and a second line segment formed at the other side of the first and second rectangular regions opposed to the first line segment, with its projection crossing the coupled microstrip lines, wherein the first line segment comprises a first sub line segment, a second sub line segment and a third sub line segment, the second sub line segment is parallel with the third rectangular region, the first sub line segment and the third sub line segment face toward the second line segment and form an angle with the second sub line segment; and the second line segment comprises a fourth sub line segment, a fifth sub line segment and a sixth sub line segment, the fifth sub line segment is parallel with the third rectangular region, the fourth sub line segment and the sixth sub line segment face toward the first line segment and form an angle with the fifth sub line segment. Preferably, the angle is 90 degree.

According to another embodiment, the defected ground structure further comprises: a fourth rectangular region connected to one side of the first rectangular region facing the second rectangular region, one side of the fourth rectangular region being flush with an upper side of the first rectangular region; a fifth rectangular region connected to one side of the first rectangular region facing the second rectangular region, one side of the fifth rectangular region being flush with a lower side of the first rectangular region; a sixth rectangular region connected to one side of the second rectangular region facing the first rectangular region, one side of the sixth rectangular region being flush with an upper side of the second rectangular region; and a seventh rectangular region connected to one side of the second rectangular region facing the first rectangular region, one side of the seventh rectangular region being flush with a lower side of the second rectangular region.

Preferably, the above-described defected ground structure further comprises: a third line segment formed at one side of the first and second rectangular regions, with its projection crossing the coupled microstrip lines; and a fourth line segment formed at the other side of the first and second rectangular regions opposed to the third line segment, with its projection crossing the coupled microstrip lines, wherein the third line segment comprises a seventh sub line segment, an eighth sub line segment and a ninth sub line segment, the eighth sub line segment is parallel with the third rectangular region, the seventh sub line segment and the ninth sub line segment face toward the fourth line segment and form an angle of 90 degree with the eighth sub line segment; and the fourth line segment comprises a tenth sub line segment, an eleventh sub line segment, and a twelfth sub line segment, the eleventh sub line segment is parallel with the third rectangular region, the tenth sub line segment and the twelfth sub line segment face toward the third line segment and form an angle of 90 degree with the eleventh sub line segment.

The present invention further provides a common mode filtering method applied in a common mode filtering device with a defected ground structure, wherein the common mode filtering device comprises a substrate, coupled microstrip lines formed on the substrate and a ground plane formed underneath the substrate, the common mode filtering method comprising: (1) forming at least one defected ground structure on the ground plane; and (2) making dual mode signals pass through the coupled microstrip lines, wherein the defected ground structure comprises: a first rectangular region, a second rectangular region which has a same size as the first rectangular region and is parallel with the first rectangular region, and a third rectangular region with two sides thereof connecting the first and second rectangular regions respectively, the sides of the first and second rectangular regions contacting the third rectangular region having a length greater than said two sides of the third rectangular region.

In the present invention, since differential mode signals and common mode signals passing through the coupled microstrip lines have different reference return path, a defected ground structure equivalent to a LC resonator can be formed on the return ground path of the common mode signals so as to suppress the common mode signals without affecting the differential mode signals. Through different defected ground structures, the present invention not only suppresses common mode noises over a wider frequency band and increases the insertion loss, but also reduces etching area of the ground plane, thereby simplifying the fabrication process, saving the fabrication cost and reducing the circuit volume.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification.

Figure 1:
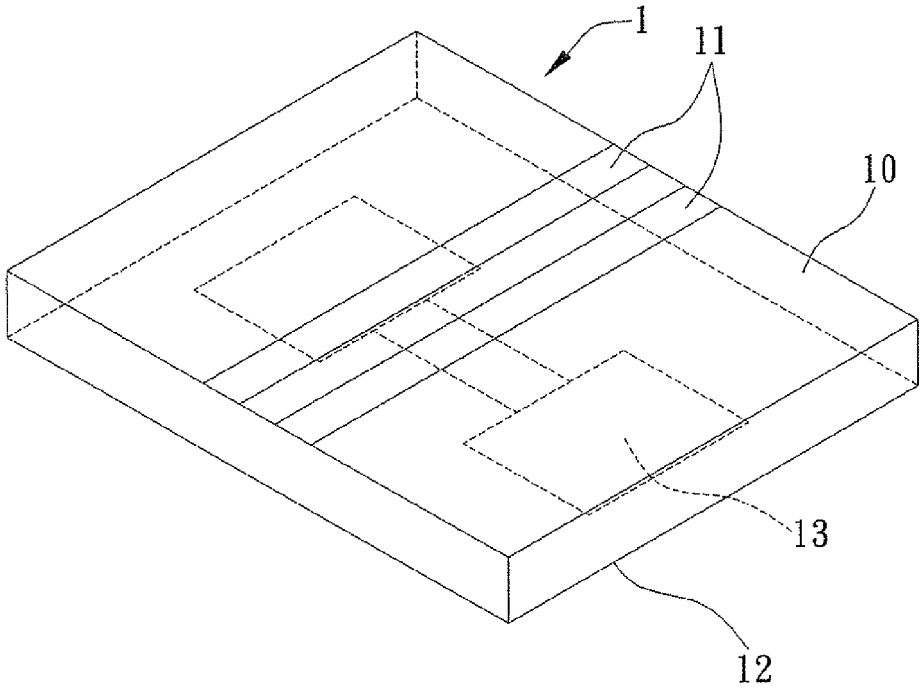
FIG. 1 shows the structure of a common mode filtering device for use with a defected ground structure according to the present invention.

FIG. 1 shows a common mode filtering device for use with a defected ground structure according to the present invention. As shown in the drawing, the common mode filtering device comprises a substrate 10, coupled microstrip lines 11, a ground plane 12 and a defected ground structure 13.

The substrate 10 is the core of a printed circuit board. The substrate 10 is made up of resin, reinforcing material and/or metal foil. The most common substrate is a copper clad laminate (CCL) substrate, which is formed by adhering a copper foil to single or double surfaces of a base material at high temperature and high pressure and using a polymer resin such as an epoxy resin, phenolic resin, polyamine-formaldehyde resin, silicone resin or Teflon as an adhesive. The copper foil is formed by depositing copper on a rolling wheel immersed in sulfuric acid electrolyte. During the electroplating process, the copper surface tends to become rough such that it is easy to be adhered to the substrate 10. However, it should be noted that the substrate is not limited to the above-described material.

The coupled microstrip lines 11 comprise two microstrip lines, which are a kind of planar transmission line. The microstrip lines are metal line segments formed on the substrate and have predetermined length and width corresponding to desired frequency and impedance characteristics. When the two unshielded microstrip lines are close to each other, their electromagnetic fields interact with each other so as to form the coupled microstrip lines 11.

The ground plane 12 is a metal contact layer of the substrate 10. The ground plane 12 is etched in different shapes so as to obtain a defected ground structure 13 which can change transmission characteristic of the couple microstrip lines 11. The defected ground structure 13 can be equivalent to a parallel LC resonant circuit such that energy of a part of signals at resonant frequency can be absorbed by the ground layer, thereby forming a band stop effect at specific frequency.

Figure 2:
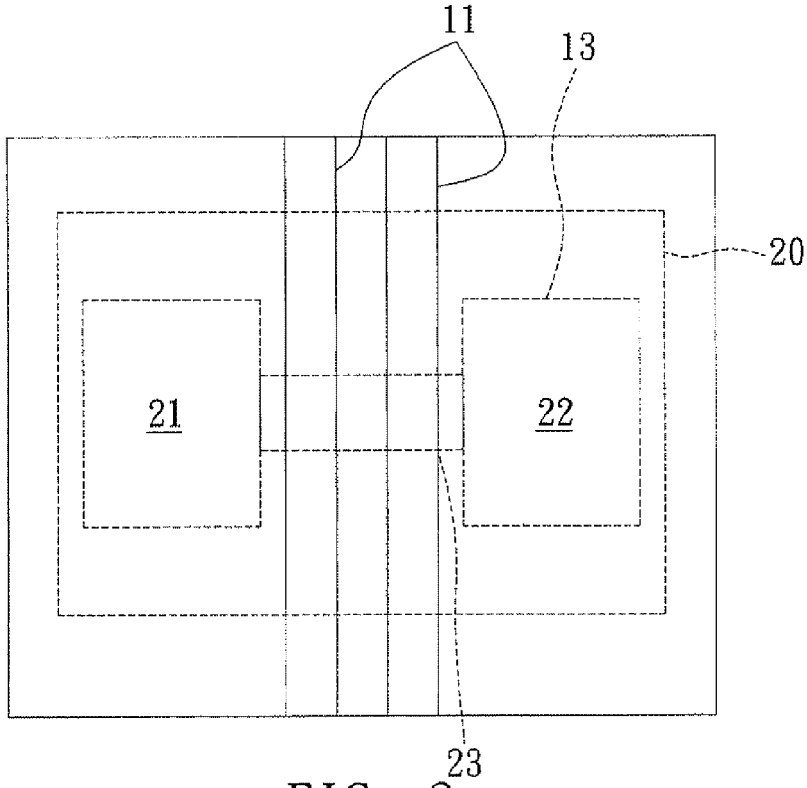
FIG. 2 shows a common mode filtering device for with a defected ground structure according to a first embodiment of the present invention.

FIG. 2 shows a common mode filtering device for use with a defected ground structure according to a first embodiment of the present invention. The defected ground structure 13 of the common mode filtering device comprises a first rectangular region 21, a second rectangular region 22 and a third rectangular region 23, wherein the first rectangular region 21 has a size same as that of the second rectangular region 22 and is parallel with the second rectangular region 22, two sides of the third rectangular region 23 connect the first and second rectangular regions 21, 22 respectively, and sides of the first and second rectangular regions 21, 22 contacting the third rectangular region 21 have a length longer than said sides of the third rectangular region 21.

In practical application, dual mode signals are passed through the coupled microstrip lines 11. The dual mode signals comprise differential mode signals and common mode signals, wherein the reference return path of the common mode signals passes through the ground plane 12 and accordingly the defected ground structure 13 influences the common mode signals by increasing insertion loss at specific frequency band so as to suppress passing through of the common mode signals.

In a preferred embodiment, an axis parallel with the horizontal direction of the third rectangular region 23 and passing through the centroid of the third rectangular region 23 passes through the centroids of the first rectangular region 21 and the second rectangular region 22 respectively. Accordingly, a H-shaped defected ground structure 13 which is up-down symmetric and left-right symmetric is formed.

According to another preferred embodiment, the center of the coupled microstrip lines 11 is aligned with the center of the defected ground structure 13, and the distance between the coupled microstrip lines 11 is less than the maximum range of the defected ground structure 13 on the substrate.

Figure 3:
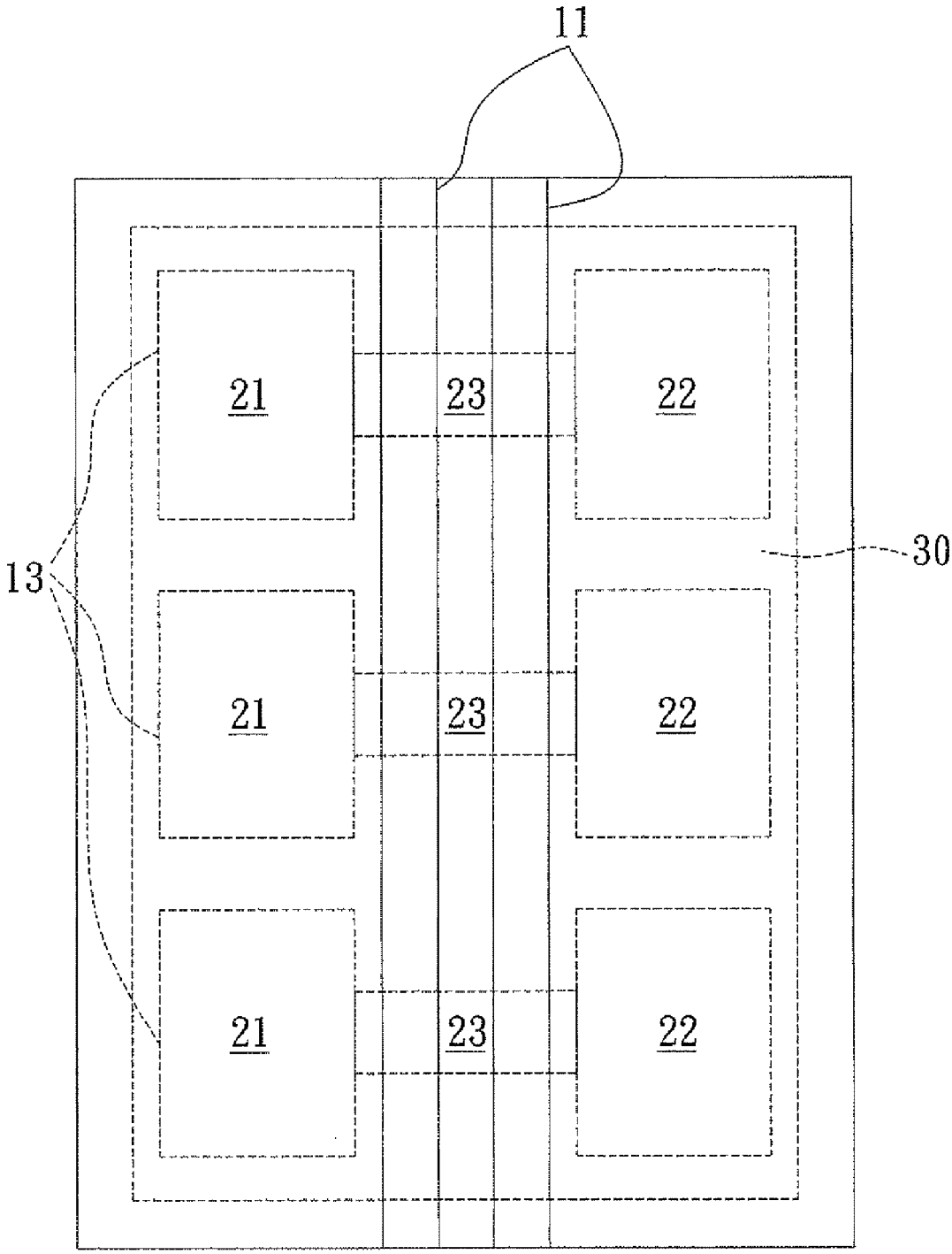
FIG. 3 shows a common mode filtering device for with a defected ground structure according to a second embodiment of the present invention.

FIG. 3 shows a common mode filtering device for use with a defected ground structure according to a second embodiment of the present invention. The defected ground structure 13 is periodically formed underneath the substrate 10. Compared with the first embodiment, the present embodiment can suppress common mode signals at a much wider frequency band and increase more insertion loss so as to obtain a better suppressing effect. However, a larger area requires to be etched in the present embodiment.

Figure 4:
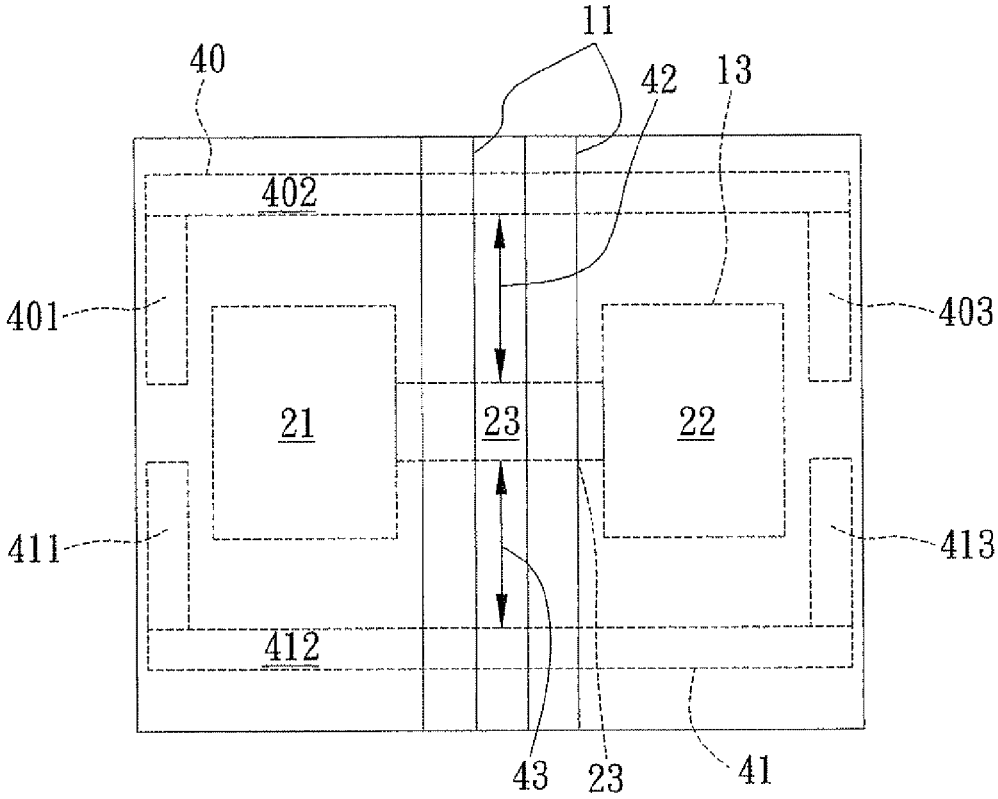
FIG. 4 shows a common mode filtering device for with a defected ground structure according to a third embodiment of the present invention.

FIG. 4 shows a common mode filtering device for use with a defected ground structure according to a third embodiment of the present invention. Compared with the first embodiment, the defected ground structure 13 of the present embodiment further comprises a first line segment 40 and a second line segment 41.

The first line segment 40 is formed at one side of the first and second rectangular regions 21, 22 and preferably spaced from the first and second rectangular regions 21, 22, and the projection of the first line segment 40 crosses the coupled microstrip lines 11.

The second line segment 41 is formed at the other side of the first and second rectangular regions 21, 22 opposed to the first line segment 40 and preferably spaced from the first and second rectangular regions 21, 22, and the projection of the second line segment 41 crosses the coupled microstrip lines 11.

The first line segment 40 comprises a first sub line segment 401, a second sub line segment 402 and a third sub line segment 403. The second sub line segment 402 is parallel with the third rectangular region 23, the first sub line segment 401 and the third sub line segment 403 face toward the second line segment 41 and form an angle with the second sub line segment 402. Preferably, the angle is 90 degree. The second line segment 41 comprises a fourth sub line segment 411, a fifth sub line segment 412, and a sixth sub line segment 413. The fifth sub line segment 412 is parallel with the third rectangular region 23, the fourth sub line segment 411 and the sixth sub line segment 413 face toward the first line segment 40 and form an angle with the fifth sub line segment 412. Preferably, the angle is 90 degree.

In a preferred embodiment, the first line segment 40 and the second line segment 41 have same size and do not overlap with each other. The first sub line segment 401 and the fourth sub line segment 411 have same size, the second sub line segment 402 and the fifth sub line segment 412 have same size, and the third sub line segment 403 and the sixth sub line segment 413 have same size.

According to another preferred embodiment, a first distance 42 is formed between the first line segment 40 and the third rectangular region 23, and a second distance 43 is formed between the second line segment 41 and the third rectangular region 23, wherein the first distance 42 is equal to the second distance 43.

In practical application, the ground plane 12 has a H-shaped defected ground structure formed at the central portion thereof, and a ⊓-shaped defected ground structure and a ⊔-shaped defected ground structure respectively formed on the upper and lower portions thereof. Compared with the first embodiment, the ⊓-shaped defected ground structure and ⊔-shaped defected ground structure of the present embodiment can suppress the common mode signals at a much wider frequency band and increase more insertion loss so as to obtain a better suppression effect. Compared with the second embodiment, the present embodiment requires less etching area, thereby efficiently reducing size of electronic elements and saving the fabrication cost.

Figure 5:
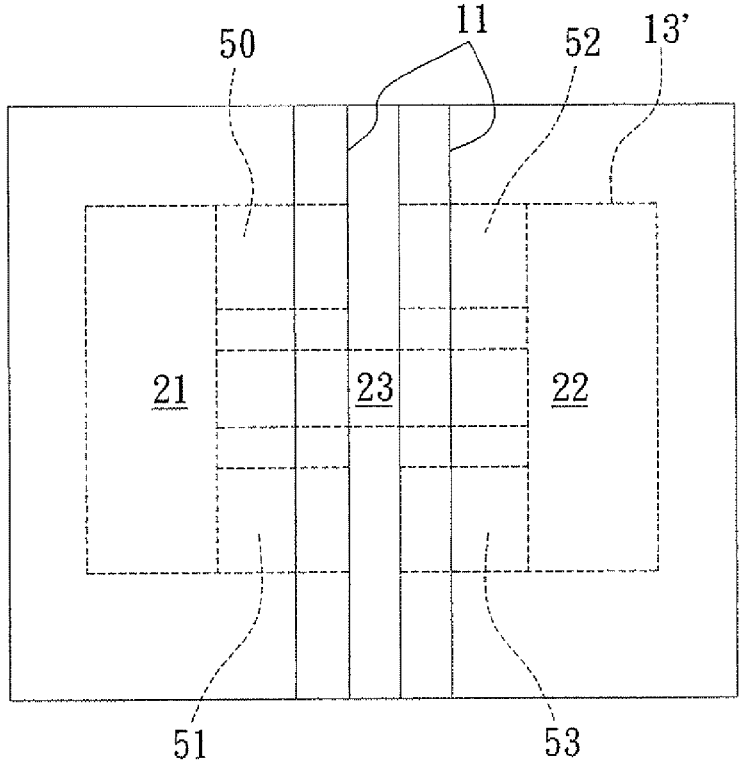
FIG. 5 shows a common mode filtering device for with a defected ground structure according to a fourth embodiment of the present invention.

FIG. 5 shows a common mode filtering device for use with a defected ground structure according to a fourth embodiment of the present invention. Compared with the first embodiment, the defected ground structure 13' of the present embodiment further comprises a fourth rectangular region 50, a fifth rectangular region 51, a sixth rectangular region 52 and a fourth rectangular region 53, wherein the fourth rectangular region 50 is connected to one side of the first rectangular region 21 facing the second rectangular region 22 and one side of the fourth rectangular region 50 is flush with an upper side of the first rectangular region 21, the fifth rectangular region 51 is connected to one side of the first rectangular region 21 facing the second rectangular region 22 and one side of the fifth rectangular region 51 is flush with a lower side of the first rectangular region 21, the sixth rectangular region 52 is connected to one side of the second rectangular region 22 facing the first rectangular region 21 and one side of the sixth rectangular region 52 is flush with an upper side of the second rectangular region 22, and the seventh rectangular region 53 is connected to one side of the second rectangular region 22 facing the first rectangular region 21 and one side of the seventh rectangular region 53 is flush with a lower side of the second rectangular region 22. The fourth rectangular region 50 is spaced from the sixth rectangular region 52, the fifth rectangular region 51 is spaced from the seventh rectangular region 53, and the fourth to seventh rectangular regions are respectively spaced from the third rectangular region 23.

In a preferred embodiment, the fourth to seventh rectangular regions have same size.

According to another preferred embodiment, the fourth rectangular region 50 and the sixth rectangular region 52 are parallel with each other, and the fifth rectangular region 51 and the seventh rectangular region 53 are parallel with each other.

Compared with the first embodiment, the defected ground structure 13' of the present embodiment comprising four additional rectangular ground structures causes the operating frequency of the common mode filter in the first embodiment to move towards low frequency, i.e., causes the frequency band of the suppressed common mode signal to shift toward low frequency, thus meeting the demand of the current products with a frequency between 1 GHz and 2 GHz. In the case the defected ground structure 13' has a same area as that of the defected ground structure 13, the defected ground structure 13' can suppress common mode signals at a lower frequency. In order to suppress common mode signals at higher frequency as in the first embodiment, the present embodiment only needs to reduce the etching area of the defected ground structure. Therefore, through application of the defected ground structure 13' of FIG. 5, size of electronic elements can be efficiently reduced and the fabrication cost can be saved.

Figure 6:
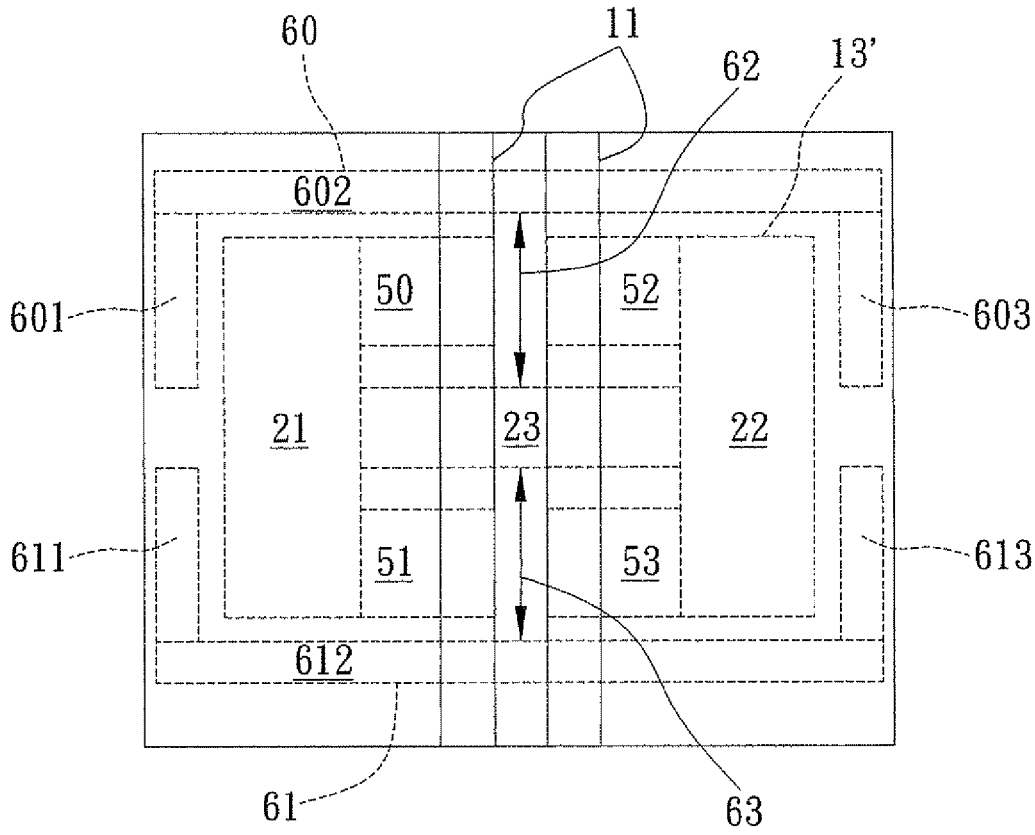
FIG. 6 shows a common mode filtering device for with a defected ground structure according to a fifth embodiment of the present invention.

FIG. 6 shows a common mode filtering device for use with a defected ground structure according to a fifth embodiment of the present invention. Compared with the fourth embodiment, the defected ground structure 13' of the present embodiment further comprises a third line segment 60 and a fourth line segment 61, wherein the third line segment 60 is formed at one side of the first and second rectangular regions 21, 22 and preferably spaced from the first, second, fourth and sixth rectangular regions 21, 22, 50, 52, and the projection of the third line segment 60 crosses the coupled microstrip lines 11, the fourth line segment 61 is formed at the other side of the first and second rectangular regions 21, 22 opposed to the third line segment 60 and preferably spaced from the first, second, fifth and seventh rectangular regions 21, 22, 51, 53, and the projection of the fourth line segment 61 crosses the coupled microstrip lines 11. The third line segment 60 comprises a seventh sub line segment 601, an eighth sub line segment 602 and a ninth sub line segment 603. The eighth sub line segment 602 is parallel with the third rectangular region 23, the seventh sub line segment 601 and the ninth sub line segment 603 face toward the fourth line segment 61 and form an angle with the eighth sub line segment 602. Preferably, the angle is 90 degree. The fourth line segment 61 comprises a tenth sub line segment 611, an eleventh sub line segment 612, and a twelfth sub line segment 613. The eleventh sub line segment 612 is parallel with the third rectangular region 23, the tenth sub line segment 611 and the twelfth sub line segment 613 face toward the third line segment 60 and form an angle with the eleventh sub line segment 612. Preferably, the angle is 90 degree.

In a preferred embodiment, the third line segment 60 and the fourth line segment 61 have same size and do not overlap with each other. The seventh sub line segment 601 and the tenth sub line segment 611 have same size, the eighth sub line segment 602 and the eleventh sub line segment 612 have same size, and the ninth sub line segment 603 and the twelfth sub line segment 613 have same size.

According to another preferred embodiment, a third distance 62 is formed between the third line segment 60 and the third rectangular region 23, and a fourth distance 63 is formed between the fourth line segment 61 and the third rectangular region 23, wherein the third distance 62 is equal to the fourth distance 63.

In practical application, as shown in FIG. 6, the ground plane 12 has a H-shaped defected ground structure 13' formed at the central portion thereof, and a ⊓-shaped defected ground structure and a ⊔-shaped defected ground structure respectively formed on the upper and lower portions thereof. As disclosed in the third embodiment, the ⊓-shaped defected ground structure and ⊔-shaped defected ground structure of the present embodiment can suppress the common mode signals at a wider frequency band and increase more insertion loss so as to obtain a better suppression effect. Therefore, the filter using the defected ground structure 13' plus the ⊓-shaped and ⊔-shaped ground structures not only obtain a preferred common mode signal suppression effect, but also efficiently reduce size of electronic elements and save the fabrication cost.

Figure 7:
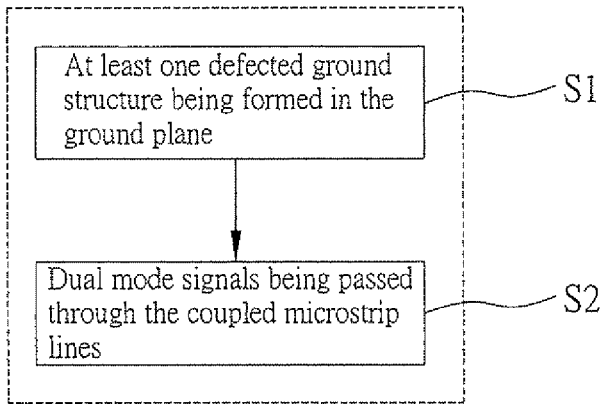
FIG. 7 is a process view of a common mode filtering method for use with a defected ground structure.

FIG. 7 shows a flow process of a common mode filtering method for use with a defected ground structure according to the present invention. The common mode filtering method is applied in a common mode filtering device with a defected ground structure, wherein the common mode filtering device comprises a substrate, coupled microstrip lines formed on the substrate and a ground plane formed underneath the substrate. The common mode filtering method according to the present invention comprises the following steps.

At step S1, at least one defected ground structure is formed in the ground plane underneath the substrate by etching or a similar method. The defected ground structure has a pattern of one of the first to fifth embodiments. Then, the process goes to step S2.

At step S2, dual mode signals are passed through the coupled microstrip lines. The dual mode signals comprise differential mode signals and common mode signals. Due to different reference return path of the differential mode signals and common mode signals passing through the coupled microstrip lines, a defected ground structure equivalent to a LC resonator is formed on the return ground path of the common mode signals so as to suppress the common mode signals without affecting the differential mode signals.

Through the above-described common mode filtering method and device for use with a defected ground structure, the present invention at least achieves the following effects:

(1) simplified fabrication process. Since the defected ground structure is formed on the known printed circuit boards, it does not require complicated fabrication processes of multi-layer boards or additional filtering elements such as common mode chokes.

(2) suppression over a wider frequency band and better suppression effect. The defected ground structure according to the present invention strengthens electromagnetic coupling relationship between LC resonant circuits so as to achieve suppression over a wider frequency band and better suppression effect.

(3) cost-saving. Compared with a conventional defected ground structure, the present invention reduces the etching area on a printed circuit board and saves the fabrication cost.

Therefore, the present invention not only achieves suppression over a wider frequency band and better suppression effect, but also provides a simplified fabrication process at lower fabrication cost, thereby increasing the competitiveness and industrial application value of the present invention.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. A common mode filtering device for use with a defected ground structure, comprising:

a substrate;

coupled microstrip lines disposed on the substrate for passing through dual mode signals; and a ground plane disposed underneath the substrate and having at least one defected ground structure for suppressing common mode signals within a specific frequency band that pass through the coupled microstrip lines, wherein the defected ground structure comprises: a first rectangular region, a second rectangular region which has a same size as the first rectangular region and is parallel with the first rectangular region, and a third rectangular region with two sides thereof connecting the first and second rectangular regions respectively, the sides of the first and second rectangular regions contacting the third rectangular region having a length greater than said two sides of the third rectangular region.

2. The device of claim 1, wherein an axis parallel with the horizontal direction of the third rectangular region and passing through the centroid of the third rectangular region passes through the centroids of the first and second rectangular regions respectively.

3. The device of claim 1, wherein the defected ground structure has a resonant characteristic equivalent to a parallel LC resonant circuit.

4. The device of claim 1, wherein the center of the coupled microstrip lines is aligned with the center of the defected ground structure.

5. The device of claim 1, wherein the distance between the coupled microstrip lines is less than the maximum range of the defected ground structure on the substrate.

6. The device of claim 1, wherein the defected ground structure is periodically formed underneath the substrate.

7. The device of claim 1, wherein the defected ground structure is formed by etching.

8. The device of claim 1, wherein the defected ground structure further comprises:

a first line segment formed at one side of the first and second rectangular regions, with its projection crossing the coupled microstrip lines; and a second line segment formed at the other side of the first and second rectangular regions opposed to the first line segment, with its projection crossing the coupled microstrip lines, wherein the first line segment comprises a first sub line segment, a second sub line segment and a third sub line segment, the second sub line segment is parallel with the third rectangular region, the first sub line segment and the third sub line segment face toward the second line segment and form an angle with the second sub line segment; and the second line segment comprises a fourth sub line segment, a fifth sub line segment and a sixth sub line segment, the fifth sub line segment is parallel with the third rectangular region, the fourth sub line segment and the sixth sub line segment face toward the first line segment and form an angle with the fifth sub line segment.

9. The device of claim 8, wherein the first line segment and the second line segment have same size.

10. The device of claim 8, wherein the first sub line segment and the fourth sub line segment have same size, the second sub line segment and the fifth sub line segment have same size, and the third sub line segment and the sixth sub line segment have same size.

11. The device of claim 8, wherein the first line segment does not overlap with the second line segment.

12. The device of claim 8, wherein the angle is 90 degree.

13. The device of claim 8, wherein a first distance is formed between the first line segment and the third rectangular region, and a second distance is formed between the second line segment and the third rectangular region.

14. The device of claim 13, wherein the first distance is equal to the second distance.

15. The device of claim 1, wherein the defected ground structure further comprises:

a fourth rectangular region connected to one side of the first rectangular region facing the second rectangular region, one side of the fourth rectangular region being flush with an upper side of the first rectangular region;

a fifth rectangular region connected to one side of the first rectangular region facing the second rectangular region, one side of the fifth rectangular region being flush with a lower side of the first rectangular region;

a sixth rectangular region connected to one side of the second rectangular region facing the first rectangular region, one side of the sixth rectangular region being flush with an upper side of the second rectangular region; and a seventh rectangular region connected to one side of the second rectangular region facing the first rectangular region, one side of the seventh rectangular region being flush with a lower side of the second rectangular region.

16. The device of claim 15, wherein the fourth rectangular region is spaced from the sixth rectangular region, the fifth rectangular region is spaced from the seventh rectangular region, and the fourth to seventh rectangular regions are respectively spaced from the third rectangular region.

17. The device of claim 15, wherein the fourth to seventh rectangular regions have same size.

18. The device of claim 15, wherein the fourth rectangular region is parallel with the sixth rectangular region, and the fifth rectangular region is parallel with the seventh rectangular region.

19. The device of claim 15, wherein the defected ground structure further comprises:

a third line segment formed at one side of the first and second rectangular regions, with its projection crossing the coupled microstrip lines; and a fourth line segment formed at the other side of the first and second rectangular regions opposed to the third line segment, with its projection crossing the coupled microstrip lines, wherein the third line segment comprises a seventh sub line segment, an eighth sub line segment and a ninth sub line segment, the eighth sub line segment is parallel with the third rectangular region, the seventh sub line segment and the ninth sub line segment face toward the fourth line segment and form an angle with the eighth sub line segment; and the fourth line segment comprises a tenth sub line segment, an eleventh sub line segment, and a twelfth sub line segment, the eleventh sub line segment is parallel with the third rectangular region, the tenth sub line segment and the twelfth sub line segment face toward the third line segment and form an angle with the eleventh sub line segment.

20. The device of claim 19, wherein the third line segment and the fourth line segment have same size.

21. The device of claim 19, wherein the seventh sub line segment and the tenth sub line segment have same size, the eighth sub line segment and the eleventh sub line segment have same size, and the ninth sub line segment and the twelfth sub line segment have same size.

22. The device of claim 19, wherein the third line segment does not overlap with the fourth line segment.

23. The device of claim 19, wherein the angle is 90 degree.

24. The device of claim 19, wherein a third distance is formed between the third line segment and the third rectangular region, and a fourth distance is formed between the fourth line segment and the third rectangular region.

25. The device of claim 24, wherein the third distance is equal to the fourth distance.

26. A common mode filtering method applied in a common mode filtering device with a defected ground structure, wherein the common mode filtering device comprises a substrate, coupled microstrip lines formed on the substrate and a ground plane formed underneath the substrate, the common mode filtering method comprising:

forming at least one defected ground structure on the ground plane; and making dual mode signals pass through the coupled microstrip lines, wherein the defected ground structure comprises: a first rectangular region, a second rectangular region which has a same size as the first rectangular region and is parallel with the first rectangular region, and a third rectangular region with two sides thereof connecting the first and second rectangular regions respectively, the sides of the first and second rectangular regions contacting the third rectangular region having a length greater than said two sides of the third rectangular region.

27. The method of claim 26, wherein an axis parallel with the horizontal direction of the third rectangular region and passing through the centroid of the third rectangular region passes through the centroids of the first and second rectangular regions respectively.

28. The method of claim 26, wherein the center of the couple microstrip lines is aligned with the center of the defected ground structure.

29. The method of claim 26, wherein the distance between the coupled microstrip lines is less than the maximum range of the defected ground structure on the substrate.

30. The method of claim 26, wherein the defected ground structure is periodically formed underneath the substrate.

31. The method of claim 26, wherein the defected ground structure further comprises:

a first line segment formed at one side of the first and second rectangular regions, with its projection crossing the coupled microstrip lines; and a second line segment formed at the other side of the first and second rectangular regions opposed to the first line segment, with its projection crossing the coupled microstrip lines, wherein the first line segment comprises a first sub line segment, a second sub line segment and a third sub line segment, the second sub line segment is parallel with the third rectangular region, the first sub line segment and the third sub line segment face toward the second line segment and form an angle with the second sub line segment; and the second line segment comprises a fourth sub line segment, a fifth sub line segment and a sixth sub line segment, the fifth sub line segment is parallel with the third rectangular region, the fourth sub line segment and the sixth sub line segment face toward the first line segment and form an angle with the fifth sub line segment.

32. The method of claim 31, wherein the first sub line segment and the fourth sub line segment have same size, the second sub line segment and the fifth sub line segment have same size, and the third sub line segment and the sixth sub line segment have same size.

33. The method of claim 31, wherein the first line segment does not overlap with the second line segment.

34. The method of claim 31, wherein the angle is 90 degree.

35. The method of claim 31, wherein a first distance is formed between the first line segment and the third rectangular region, and a second distance is formed between the second line segment and the third rectangular region.

36. The method of claim 33, wherein the first distance is equal to the second distance.

37. The method of claim 26, wherein the defected ground structure further comprises:

a fourth rectangular region connected to one side of the first rectangular region facing the second rectangular region, one side of the fourth rectangular region being flush with an upper side of the first rectangular region;

a fifth rectangular region connected to one side of the first rectangular region facing the second rectangular region, one side of the fifth rectangular region being flush with a lower side of the first rectangular region;

a sixth rectangular region connected to one side of the second rectangular region facing the first rectangular region, one side of the sixth rectangular region being flush with an upper side of the second rectangular region; and a seventh rectangular region connected to one side of the second rectangular region facing the first rectangular region, one side of the seventh rectangular region being flush with a lower side of the second rectangular region.

38. The method of claim 37, wherein the fourth rectangular region is spaced from the sixth rectangular region, the fifth rectangular region is spaced from the seventh rectangular region, and the fourth to seventh rectangular regions are respectively spaced from the third rectangular region.

39. The method of claim 37, wherein the fourth to seventh rectangular regions have same size.

40. The method of claim 37, wherein the fourth rectangular region is parallel with the sixth rectangular region, and the fifth rectangular region is parallel with the seventh rectangular region.

41. The method of claim 37, wherein the defected ground structure further comprises:

a third line segment formed at one side of the first and second rectangular regions, with its projection crossing the coupled micro strip lines; and a fourth line segment formed at the other side of the first and second rectangular regions opposed to the third line segment, with its projection crossing the coupled microstrip lines, wherein the third line segment comprises a seventh sub line segment, an eighth sub line segment and a ninth sub line segment, the eighth sub line segment is parallel with the third rectangular region, the seventh sub line segment and the ninth sub line segment face toward the fourth line segment and form an angle with the eighth sub line segment; and the fourth line segment comprises a tenth sub line segment, an eleventh sub line segment, and a twelfth sub line segment, the eleventh sub line segment is parallel with the third rectangular region, the tenth sub line segment and the twelfth sub line segment face toward the third line segment and form an angle with the eleventh sub line segment.

42. The method of claim 41, wherein the seventh sub line segment and the tenth sub line segment have same size, the eighth sub line segment and the eleventh sub line segment have same size, and the ninth sub line segment and the twelfth sub line segment have same size.

43. The method of claim 41, wherein the third line segment does not overlap with the fourth line segment.

44. The method of claim 41, wherein the angle is 90 degree.

45. The method of claim 41, wherein a third distance is formed between the third line segment and the third rectangular region, and a fourth distance is formed between the fourth line segment and the third rectangular region.

46. The method of claim 45, wherein the third distance is equal to the fourth distance.

* * * * *